US005599591A

United States Patent [19]

Shiraiwa

[11] Patent Number: 5,599,591

[45] Date of Patent: Feb. 4, 1997

[54] METHOD OF IMPROVING THE ELECTRICAL CONDUCTIVITY OF A SHAPED RESIN ARTICLE AND AN ELECTROSTATIC COATING PROCESS

[75] Inventor: Tetsuo Shiraiwa, Osaka, Japan

[73] Assignee: Dai-Ichi Kogyo Seiyaku Co., Ltd., Kyoto, Japan

[21] Appl. No.: 602,649

[22] Filed: Feb. 16, 1996

[30] Foreign Application Priority Data

Mar. 15, 1995 [JP] Japan ..... 7-055701

[51] Int. Cl.[6] ..... B05D 1/04

[52] U.S. Cl. ..... 427/458; 264/104; 427/58; 427/322; 427/421; 427/444; 427/475; 427/536; 427/540; 427/569

[58] Field of Search ..... 264/104; 427/458, 427/475, 536, 540, 569, 58, 322, 421, 444

[56] References Cited

FOREIGN PATENT DOCUMENTS 50-66538 6/1975 Japan .
3-101875 4/1991 Japan .

*Primary Examiner*—Bernard Pianalto
*Attorney, Agent, or Firm*—Jordan and Hamburg

[57] ABSTRACT

A nitrogen-containing compound of the following general formula (1) is kneaded into a resin molding material, the kneaded mixture is molded and the surface of the resulting article is subjected to corona discharge treatment. Further, a coating material having electrostatic charges is sprayed and deposited on the article after the corona discharge treatment. This can provide a shaped resin article with remarkably improved electrical conductivity from a less electrically conductive resin, without substantially deteriorating the physical properties and the color of the article. Further, electrostatic coating excellent in coating efficiency, surface appearance, productivity or the like is possible.

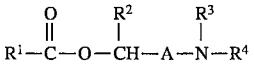

(1)

where $R^1$ represents an alkyl group or alkenyl group of 5 to 21 carbon atoms, $R^2$ represents —H or —$CH_3$, $R^3$ and $R^4$ may be the same or different and each represents an alkyl group of 1 to 4 carbon atoms, A represents —$(CH_2)_n$— or

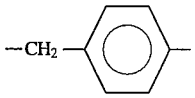

and n is 1 to 5.

3 Claims, No Drawings

METHOD OF IMPROVING THE ELECTRICAL CONDUCTIVITY OF A SHAPED RESIN ARTICLE AND AN ELECTROSTATIC COATING PROCESS

BACKGROUND OF THE INVENTION

The present invention relates to a method of improving the electrical conductivity of a shaped resin article and an electrostatic coating process.

A known method of applying electrostatic coating after improving the electrical conductivity of a shaped resin article includes, for example, a method of forming an electrically conductive primer layer by coating an electrically conductive paint containing an electrically conductive metal powder on the surface of a shaped resin article to provide electrical conductivity and then applying electrostatic coating as disclosed in JP-A-50066538 or a method of kneading an electrically conductive inorganic substance such as carbon black, carbon fiber or electrically conductive mica into a resin molding material, then molding the same and applying electrostatic coating thereto.

However, when an electrically conductive primer layer is formed on the surface of a shaped resin article as disclosed in JP-A-50066538, adhesion between the surface of the resin article and the electrically conductive primer is poor and a plurality kinds of electrically conductive primer layers have to be formed as a plurality of layers in order to improve the drawback. This not only brings about a problem in view of the electrical conductivity and the productivity but also leads to a problem in view of coating losses or increased costs by the use of a plurality kinds of electrically conductive primers.

Furthermore, when electrostatic coating is applied to a shaped article kneaded with an electrically conductive inorganic substance such as carbon black, carbon fiber, conductive mica or the like, since the electrically conductive substance must be kneaded in a large amount into the resin molding material, this results in problems of tending to detract from the physical properties of the resin article and affects the color on the electrostatically coated surface by the coloration of the resin article.

Recently, there is disclosed a method as in JP-A-03101875 of kneading a complex of a polyoxyalkylene polyol with a soluble electrolyte salt into a resin molding material, molding the kneaded mixture, subjecting the surface of the resultant shaped article to a plasma treatment and then applying electrostatic coating. However, the method is poor in the productivity since the plasma treatment is a batch operation and involves a problem that the article has to be treated under a reduced pressure.

SUMMARY OF THE INVENTION

The subject of the present invention is to overcome the foregoing drawbacks of the prior art and provide a method of improving the electrical conductivity of a shaped resin article with excellent productivity and without causing problems to the physical properties and the color of the shaped resin article, as well as an electrostatic coating process of a shaped resin article excellent in the coating property, deposition property and productivity.

In accordance with the present invention, the foregoing subject has been solved based on the finding that the electrical conductivity can be improved by kneading a specified nitrogen-containing compound, molding the kneaded mixture and subjecting the surface of the shaped article to corona discharge treatment after molding, and the surface of the shaped article can be modified so as to be suitable to the electrostatic coating property.

That is, the present invention provides a method of improving the electrical conductivity of a shaped resin article, wherein a nitrogen-containing compound of the following general formula (1) is kneaded into a resin molding material, the kneaded mixture is molded, and then the surface of the resulting article is subjected to corona discharge treatment. Further, the present invention also provides an electrostatic coating process for a shaped resin article, wherein a coating material having electrostatic charges is sprayed and deposited on the shaped article after the corona discharging treatment:

$$R^1-\overset{\overset{\displaystyle O}{\|}}{C}-O-\overset{\overset{\displaystyle R^2}{|}}{CH}-A-\overset{\overset{\displaystyle R^3}{|}}{N}-R^4 \qquad (1)$$

where $R^1$ represents an alkyl group or alkenyl group of 5 to 21 carbon atoms, $R^2$ represents —H or —$CH_3$, $R^3$ and $R^4$ may be the same or different and each represents an alkyl group of 1 to 4 carbon atoms, A represents —$(CH_2)_n$— or

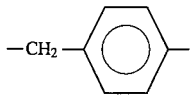

and n is 1 to 5.

In the process of the present invention, the nitro-gen-containing compound (1) present in the surface layer of the shaped resin article is activated and seems to be partially quaternarized by corona discharge, so that the surface resistivity of the article is lowered and a shaped resin article of good productivity with remarkably improved electrical conductivity compared with the conventional article can be obtained. Further, electrostatic coating of excellent coating property is enabled in cooperation with the surface improving effect by the corona discharge treatment.

DETAILED DESCRIPTION OF THE PREFERRED EMBODIMENTS

In the present invention, any resin having high surface resistivity can be used as the resin molding material, for example, polyolefin resin such as polyethylene, polypropylene, rubber-containing polypropylene (containing an ethylene-propylene copolymer rubber), ABS resin, acrylic resin, polyamide resin, polyvinyl chloride resin, polycarbonate resin, polyacetal resin and phenol resin.

In the general formula (1), $R^1$ represents an alkyl group or alkenyl group of 5 to 21 carbon atoms, preferably an alkyl group or alkenyl group of 7 to 17 carbon atoms and, particularly preferably, an alkyl group or alkenyl group of 9 to 15 carbon atoms.

The nitrogen-containing compound of the general formula (1) includes, for example, fatty acid esters such as 2-dimethyl amino ethanol caproate, 3-dimethyl amino-1-propanol caproate, 1-dimethyl amino-2-propanol caproate, 2-dimethyl amino ethanol caprylate, 2-diethyl amino ethanol caprylate, 3-dimethyl amino-1-propanol caprylate, 1-diethyl amino-2-propanol caprylate, 2-dimethyl amino ethanol caprate, 2-dibutyl amino ethanol caprate, 3-diethyl amino-1-propanol caprate, 1-dibutyl amino-2-propanol caprate, 2-dimethyl amino ethanol undecylate, 3-dimethyl amino-1-propanol undecylate, 1-dimethyl amino-2-propanol undecylate, 6-dimethyl amino-1-hexanol undecylate, 2-dimethyl amino ethanol laurate, 2-diethyl amino ethanol laurate, 2-dibutyl amino ethanol laurate, 3-dimethyl amino-1-propanol laurate, 1-dimethyl amino-2-propanol laurate, 4-dimethyl amino phenethyl alcohol laurate, 2-dimethyl amino ethanol myristate, 2-diethyl amino ethanol myristate, 3-diethyl amino-1-propanol myristate, 1-dimethyl amino-2-propanol myristate, 2-dimethyl amino ethanol pentadecylate, 3-dimetyl amino-1-propanol pentadecylate, 1-dimethyl amino-2-propanol pentadecylate, 2-dimethyl amino ethanol palmitate, 2-dibutyl amino ethanol palmitate, 3-dimethyl amino-1-propanol palmitate, 1-dimethyl amino-2-propanol palmirate, 4-dimethyl amino-1-butanol palmitate, 2-dimethyl amino ethanol stearate, 2-diethyl amino ethanol stearate, 3-dimethyl amino-1-propanol stearate, 1-dimethyl amino-2-propanol stearate, 2-dimethyl amino ethanol oleate, 3-dibutyl amino-1-propanol oleate, 2-dimethyl amino ethanol behenate, 3-dimethyl amino-1-propanol behenate, and 1-dimethyl amino-2-propanol behenate.

These fatty acid esters can be produced by reacting a fatty acid of 6 to 22 carbon atoms with an N,N-dialkyl amino alcohol such as 2-dimethyl amino ethanol, 2-diethyl amino ethanol, 2-dibutyl amino ethanol, 3-dimethyl amino-1-propanol, 3-diethyl amino-1-propanol, 3-dibutyl amino-1-propanol, 1-dimethyl amino-2-propanol, 1-diethyl amino-2-propanol, 1-dibutyl amino-2-propanol, 4-dimethyl amino-1-butanol, 6-dimethyl amino-1-hexanol, 4-dimethyl amino phenethyl alcohol. The reaction can be carried out by any known esterification reaction process. That is, the reaction preceeds as said reactants are heated together at a temperature of 140° to 230° C. The progress of reaction can be monitored by determining the acid value.

The amount of the nitrogen-containing compound of the above general formula (1) used is, preferably, from 0.01 to 10 parts by weight, more preferably, from 0.05 to 5 parts by weight and, particularly preferably, from 0.1 to 3 parts by weight based on 100 parts by weight of the resin molding material. If it is less than 0.01 parts by weight, a shaped resin article with sufficient electrical conductivity is hard to obtain. On the other hand, addition in excess of 10 parts by weight is favorable for the improvement of electrical conductivity but offers no remarkable merit since this deteriorates the physical property and causes surface bleeding regarding compatibility with the resin.

Upon addition of the nitrogen-containing compound of the general formula (1) by kneading it into the resin molding material, other antistatic reagents or process stabilizers can be used in combination so long as this does not substantially change the advantageous effect of the present invention.

As a method of kneading the nitrogen-containing compound of the general formula (1) into the resin molding material, any of conventional methods such as using twin-screw extrusion and hot roll can be used. Also with regard to the method of molding the resin, any of injection molding, calendering, compression molding, SMC and other methods can be employed.

For the corona discharge treatment, a method of applying a high voltage across two conductors at an atmospheric pressure and causing the thus generated corona to contact the surface of the load (a shaped resin article) is employed. The treating conditions are not particularly critical, providing that they induce corona discharge and, for example, the application voltage may be about 10 to 100 KV and the treating time may be not more than about 100 seconds.

Then, electrostatic coating can be performed by using any known method, for example, by means of an electric centrifugal air coating machine, an airless mist coating machine or the like. The application voltage is about −30 KV to about −120 KV. The coating material can be any of coating materials used conventionally such as urethane, acrylic, alkyd, melamine and other paints.

As described above, in accordance with the present invention, a shaped resin article with remarkably improved electrical conductivity can be obtained by using a resin of low electrical conductivity without substantially deteriorating the physical properties and the color of the article and electrostatic coating with high coating efficiency, surface appearance and productivity is possible.

The present invention is to be explained more in details with reference to examples and comparative examples but the invention is not restricted only to such examples.

EXAMPLES 1–14

As shown in Table 1, a predetermined amount of a nitrogen-containing compound of the general formula (1) was added to 1 kg of a resin molding material and the feed was kneaded at 180° C. for 10 minutes by using a twin-screw extruder to obtain pellets. The pellets were molded by using an injection molding machine (Hyper Shot, manufactured by Niigata Engineering Co.) to obtain shaped articles measuring 230 mm×230 mm×3 mm. The surface of the article was subjected to corona discharge treatment (high frequency power source: High Frequency Power Supply HFS-203, manufactured by Kasuga Denki Co.) at an application voltage of 30 KV, for 20 seconds to prepare test pieces. Immediately, the surface resistivity and the tensile strength of the test pieces were measured. The surface resistivity was measured by using a Super-insulation Resistance Meter 4329 A manufactured by YHP (Yokogawa-Hewlett Packard Co.) at an application voltage of 500 V at the time point of 30 seconds after voltage application (humidity: 65%, temperature: 20° C.). The tensile strength was measured in accordance with JIS K 7113.

Then, the above test piece was grounded to the earth and electrostatically coated with an urethane paint (R-315, manufactured by Nippon B Chemical Co.) by using a coating machine (μμBEL30ϕ, manufactured by Ransburg-Gema Co.) at a static voltage of −40 KV, a reciprocation stroke of 400 mm, a spray distance of 300 mm and a conveyor speed of 2.2 m/min. After drying for 30 minutes at 120° C., the coating film thickness and the coating efficiency were measured.

Each of the test results is shown in Table 1.

COMPARATIVE EXAMPLES 1–6

Procedures were repeated in the same manner as those in Examples 1–14 except for using the nitrogen-containing compounds and corona discharge treatment shown in Table 2. Each of the test results is shown in Table 2.

As apparent from Tables 1 and 2, the present invention is superior to the prior art in the physical properties and the electrical conductivity of the shaped resin article and in the coating efficiency of the coated article.

TABLE 1

| | Nitrogen containing compound of general formula (1) | Addition amount g (pbw) *1 | Resin molding material *2 | Corona discharge treatment | Surface resistivity (Ω) | Tensile Strength (kg/cm$^2$) | Film thickness (μm) *3 | Coating efficiency (%) *4 |
|---|---|---|---|---|---|---|---|---|
| Example 1 | A | 10(1) | PP | Yes | $8.1 \times 10^{10}$ | 320 | 33 | 79 |
| Example 2 | B | 10(1) | PP | Yes | $5.2 \times 10^{10}$ | 322 | 34 | 80 |
| Example 3 | C | 10(1) | PP | Yes | $2.5 \times 10^{10}$ | 324 | 36 | 84 |
| Example 4 | D | 10(1) | PP | Yes | $4.6 \times 10^{10}$ | 325 | 35 | 83 |
| Example 5 | E | 10(1) | PP | Yes | $7.9 \times 10^{10}$ | 326 | 34 | 80 |
| Example 6 | F | 10(1) | PP | Yes | $1.7 \times 10^{11}$ | 327 | 32 | 78 |
| Example 7 | G | 10(1) | PP | Yes | $9.0 \times 10^{10}$ | 323 | 33 | 80 |
| Example 8 | H | 10(1) | PP | Yes | $8.9 \times 10^{10}$ | 325 | 33 | 80 |
| Example 9 | D | 0.3(0.03) | PP | Yes | $3.7 \times 10^{11}$ | 331 | 32 | 78 |
| Example 10 | D | 0.8(0.08) | PP | Yes | $1.4 \times 10^{11}$ | 329 | 33 | 80 |
| Example 11 | D | 40(4) | PP | Yes | $2.3 \times 10^{10}$ | 318 | 35 | 83 |
| Example 12 | D | 80(8) | PP | Yes | $1.6 \times 10^{10}$ | 314 | 36 | 84 |
| Example 13 | C | 10(1) | PE | Yes | $4.3 \times 10^{10}$ | 151 | 35 | 83 |
| Example 14 | C | 10(1) | ABS | Yes | $4.7 \times 10^{10}$ | 403 | 34 | 80 |

A: 2-dimethyl amimo ethanol caproate
B: 3-dimethyl amino-1-propanol caprylate
C: 2-dimethyl amino ethanol laurate
D: 1-dimethyl amino-2-propanol myristate
E: 1-dimethyl amino-2-propanol stearate
F: 3-dimethyl amino-1-propanol behenate
G: 6-dimethyl amino-1-hexanol undecylate
H: 4-dimethyl amino-1-butanol palmitate
*1: The figure in parentheses denotes the addition amount, in parts by weight, of the nitrogen-containing compound based on 100 parts by weight of the resin molding material.
*2: PP (Polypropylene resin; ME 230, manufactured by Union Polymer Co.)
PE (Polyethylene resin; Mitsubishi Polyethylene LDZF-51, manufactured by Dia Polymer Co.)
ABS (ABS resin; Cycolac T, manufactured by Ube Cycone Co.)
*3: Film thickness was visually measured by microscopic observation for the cross section of the test piece.
*4: Coating efficiency was determined based on the relationship of the difference between the weight before coating and the weight after coating with the absolute dry weight of the dispensed coating by means of the following equation: Coating efficiency (%) = (The weight of the test piece after coating − the weight of the test piece before coating) ÷ the absolute dry weight of the dispensed coating × 100

TABLE 2

| | Nitrogen containing compound of general formula (1) | Addition amount g (pbw) *1 | Resin molding material *2 | Corona discharge treatment | Surface resis-tivity (Ω) | Tensile Strength (kg/cm$^2$) | Film thickness (μm) *3 | Coating efficiency (%) *4 |
|---|---|---|---|---|---|---|---|---|
| Comparative Example 1 | No | 0 | PP | Yes | $2.1 \times 10^{16}$ | 330 | 8 | 25 |
| Comparative Example 2 | C | 10(1) | PP | No | $1.2 \times 10^{16}$ | 324 | 7 | 23 |
| Comparative Example 3 | No | 0 | PE | Yes | $1.7 \times 10^{16}$ | 162 | 7 | 23 |
| Comparative Example 4 | C | 10(1) | PE | No | $1.4 \times 10^{16}$ | 151 | 8 | 25 |
| Comparative Example 5 | No | 0 | ABS | Yes | $2.4 \times 10^{16}$ | 410 | 8 | 25 |
| Comparative Example 6 | C | 10(1) | ABS | No | $2.0 \times 10^{16}$ | 403 | 7 | 23 |

C: 2-dimethyl amino ethanol laurate
*1, *2, *3, *4: Same as in Table 1

What is claimed is:

1. A method of improving the electrical conductivity of a shaped resin article which comprises kneading a nitrogen-containing compound of the following general formula (1) into a resin molding material, molding the kneaded mixture and subjecting the surface of the resulting article to corona discharge treatment:

$$R^1-\overset{\overset{\displaystyle O}{\|}}{C}-O-\overset{\overset{\displaystyle R^2}{|}}{CH}-A-\overset{\overset{\displaystyle R^3}{|}}{N}-R^4 \quad (1)$$

where $R^1$ represents an alkyl group or alkenyl group of 5 to 21 carbon atoms, $R^2$ represents —H or —$CH_3$, $R^3$ and $R^4$ may be the same or different and each represents an alkyl group of 1 to 4 carbon atoms, A represents —$(CH_2)_n$— or

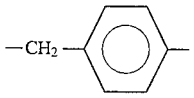

and n is 1 to 5.

2. A method of improving the electrical conductivity of a shaped resin article as defined in claim 1, wherein the amount of use of the nitrogen-containing compound of the general formula (1) is from 0.01 to 10 parts by weight based on 100 parts by weight of the resin molding material.

3. An electrostatic coating process for a shaped resin article which comprises spraying and depositing a coating material having electrostatic charges on the shaped resin article obtained by the method as defined in claim 1 or 2.

* * * * *